United States Patent [19]

Ellefson, deceased

[11] 4,016,679

[45] Apr. 12, 1977

[54] TRAFFIC CONTROL APPARATUS

[75] Inventor: Clarence L. Ellefson, deceased, late of Burbank, Calif., by Charlotte Vivian Ellefson, executrix

[73] Assignee: Rusco Industries, Inc., Los Angeles, Calif.

[22] Filed: May 19, 1975 (Under Rule 47)

[21] Appl. No.: 579,030

[52] U.S. Cl. ..... 49/49; 49/35; 49/131

[51] Int. Cl.[2] ..... E01F 13/00

[58] Field of Search ..... 49/35, 49, 131–134

[56] References Cited

UNITED STATES PATENTS

| | | | |
|---|---|---|---|
| 1,563,637 | 12/1925 | Lundblad | 49/49 |
| 2,741,859 | 4/1956 | Castle | 49/49 |
| 3,667,160 | 6/1972 | Solloum | 49/35 |
| 3,783,558 | 1/1974 | Keator | 49/49 |

*Primary Examiner*—Kenneth Downey
*Attorney, Agent, or Firm*—Perry E. Turner

[57] ABSTRACT

A plurality of teeth are individually rotatable on a shaft via integral hubs which are slidably mounted on and rotatable relative to the shaft. A bar is held parallel to the shaft by rigid connecting members between them, and respective biasing springs are connected to the bar and to respective fingers that are integral with the hubs. The shaft is rotatable in spaced brackets which are welded to the bottom of a slotted plate that is removably anchored in the top of a housing or frame that is adapted for embedment in a street surface or parking lot surface. The shaft is keyed to gear mechanism supported by the surface plate, the gearing being such as to permit the shaft to remain in a selected angular position. In one position of the shaft, all teeth protrude through slots to extend above the surface plate, and in another position all teeth are retained within the slots below the top surface of the plate. Selective positioning is effected via manual or motorized operations of the gear mechanism, and arrangements are shown for addition selective positioning of a parking gate and associated magnetic card readers in conjunction with shaft positioning.

8 Claims, 7 Drawing Figures

TRAFFIC CONTROL APPARATUS

BACKGROUND OF THE INVENTION

1. Field of the Invention

This invention relates to traffic directors of the type adapted to present physical barriers to passage of vehicles in a particular direction.

2. Description of the Prior Art

It is known to employ one-way traffic barriers in which teeth are projected from a housing in which they are rotatably mounted, and to lower the teeth into the housing when it is desired that there be no barrier to traffic in either direction. Thus, in U.S. Pat. No. 1,563,367 issued Dec. 1, 1925 for "Railway Crossing Guard," a plurality of teeth are secured to a shaft that is supported below a surface plate in an embedded housing. The teeth are normally lowered and retained in slots in the surface plate via counterweight means. To raise the teeth so they project above the roadbed to act as a barrier to traffic, solenoids are mounted at the ends of the embedded housing, and armatures for the solenoids are curved arms fixed to the shaft. The solenoids are energized by pressure of a train against a section of track adapted to close the solenoid power circuit, during which time the teeth project so as to prevent traffic from passing over them towards the tracks. After the train clears the wired track section, the circuit is broken and the solenoids deenergized to permit the teeth to lower into the slots.

It is also known to provide one-way traffic barriers in which teeth are individually pivoted. In such apparatus as heretofore made and sold, each tooth is welded to a hub that is rotatable on a shaft that is mounted at its ends in the ends of the embedded housing. Each hub has a welded finger thereon that extends at an obtuse angle from the tooth, and a tension spring is connected at its ends to the finger and to a side wall of the embedded housing.

The first-mentioned type of barrier is not practicable for use as a perpetual barrier in view of the constant power requirements to keep solenoids energized and the teeth raised. Also, such a system imposes severe burdens on the circuitry and teeth since each vehicle passing over the teeth in one direction would force all the teeth down, thus forcibly withdrawing the cores of the solenoids from their coils, because the shaft is rotated to withdraw the cores. This action occurs twice for each vehicle, since the cores are drawn into the solenoid coils after each set of wheels clears the teeth.

In the type of barrier having individually pivoted teeth, there is no known means for simultaneously lowering all teeth below the road surface when it is desired to permit traffic to flow in both directions. In this regard, each wheel passing in the allowed direction will depress only those two or three teeth spanned by the wheel, and such teeth snap back to normal projecting positions via their springs after the wheel clears them. Further, such a mechanism is undesirably time consuming and expensive to assemble, maintain and repair. For example, should a tooth be broken by the wheel of a vehicle that attempted to pass over the barrier in the wrong direction, it is necessary to remove the surface plate, disconnect the springs where they are connected to the embedded housing, lift the shaft with the hubs and shaft support plates from the housing, and slide the hubs off the shaft until the one with the broken tooth is removed. Thereafter, a hub with an unbroken tooth is replaced for the one removed, and the remaining hubs are replaced on the shaft along with the shaft support plates, following which such subassembly is lowered into the housing and the ends of the springs are connected against the anchor tabs in the housing together with the spring that is connected to the replacement tooth hub.

SUMMARY OF THE INVENTION

This invention embraces a one-way traffic barrier in which individual ones of a plurality of teeth are independently pivotable, but wherein all teeth are simultaneously movable from a barrier position to a non-barrier position, including the mounting of tooth hubs for rotation relative to a support shaft, such shaft being rotatable in support brackets welded to a surface plate to be releasably secured in the top of an embedded housing, one end of the shaft being engaged by gear mechanism supported by the surface plate, and such hubs having fingers which are connected via springs to a bar that is parallel to the shaft and secured thereto via rigid connecting members, whereby rotation of the shaft via the gear mechanism moves the teeth in unison to either a a barrier position or to a barrier removal position. Also embraced are combinations of such apparatus with parking gate and card-operated devices, and operations of the tooth supporting shaft manually or by motor means, and operations at the site or by remote controls.

DESCRIPTION OF ILLUSTRATIVE EMBODIMENTS

Figure 1:
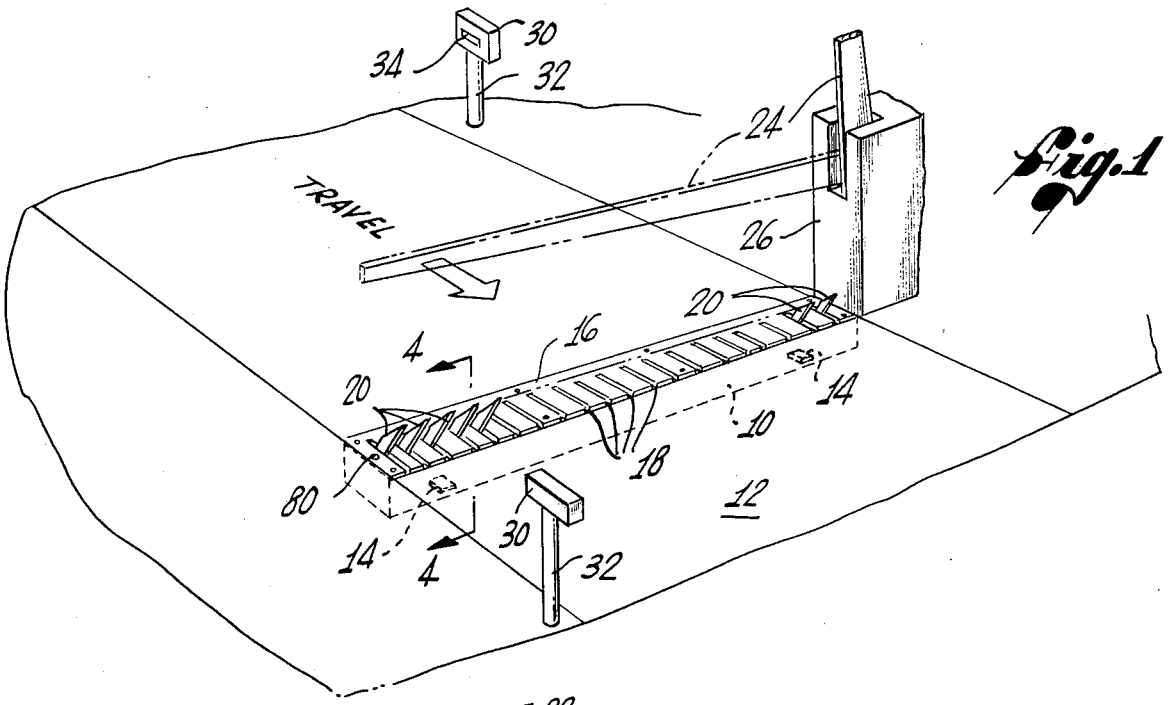
FIG. 1 is a perspective view of traffic control apparatus of the invention wherein the teeth extend to barrier position, and showing parking gate and card-operated devices for use as desired in conjunction with the surface barrier mechanism.

Referring to FIG. 1, a selectively positionable traffic control apparatus in accordance with the invention has a housing 10 embedded in a roadbed 12. The housing 10 is provided with any suitable means for keeping it anchored in place after concrete or the like has been poured around it and has set, e.g., such as laterally extending tabs 14.

Secured in the top opening of the housing 10 is a plate 16 flush with the surface of the roadbed, such surface plate having a plurality of slots 18 through which individual teeth 20 are adapted to project above the plate. The teeth 20 are appropriately shaped with sharp points and are angled in a direction to puncture tires of vehicles attempting to pass in the opposite direction, but are individually movable so as to be depressed by tires which engage them and which move in the direction in which the teeth are angled.

Also shown is a parking gate 24 pivotally supported in a housing 26 which includes suitable mechanism (not shown) well known in the art for lowering and raising such gates. As will be seen, such parking gate means may be used in conjunction with the embedded traffic director in any one of a desired number of functional relations. For example, the parking gate may normally be positioned vertically while the teeth 20 project above the roadbed, and its control mechanism rendered operable to lower the gate as shown in phantom during periods when all teeth are lowered to permit traffic flow in both directions over the surface plate 16. The gate rising mechanism may then be operated by drivers of vehicles approaching such a barrier. For example, there is shown card-receiving housings 30 on opposite sides of the road which are mounted on posts 32. Each housing has a slot 34 for receiving a magnetically encoded card. Card reader apparatus within the housing 30 are coupled to the gate operating mechanism within the housing 26 so as to cause the gate to be raised if the card inserted in the slot 34 is a valid card.

Referring to FIGS. 3–6, the teeth are individually rotatable on a shaft 49 which is supported by the surface plate 16. To this end, the shaft is shown supported in spaced rectangular plates 42 which are welded at their top edges to the bottom surface of the plate 16. The shaft 40 is rotatable in the plates 42.

Figure 3:
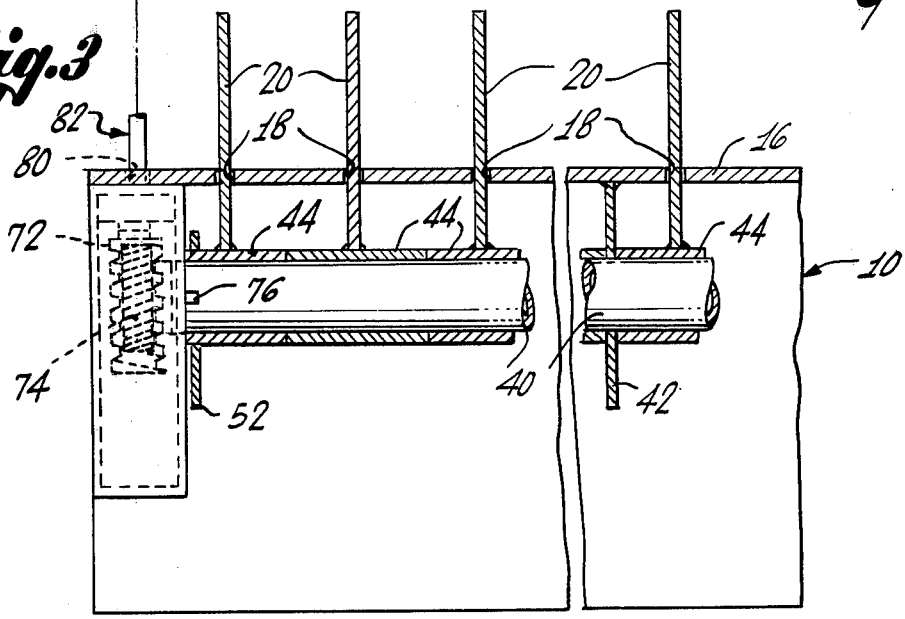
FIG. 3 is a fragmentary sectional view taken along the line 3—3 of FIG. 2.
Figure 6:
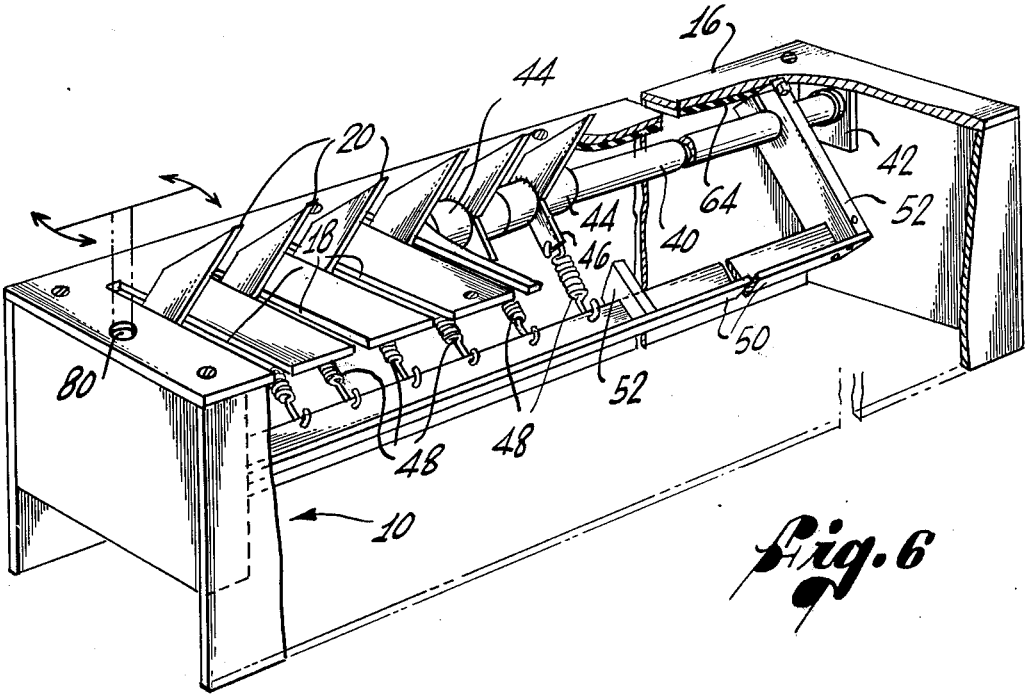
FIG. 6 is a perspective view of the traffic control apparatus, partly broken away to aid in explaining the assembly of parts and their functions.

As best seen in FIGS. 3 and 6, the teeth 20 are welded on hubs 44 which are rotatable on the shaft 40. Also integral with the hubs 44 are projecting fingers 46 (FIGS. 4 and 6) which are coupled via springs 48 to a bar 50. The bar 50 is rotatable with the shaft 40, and to this end the shaft 40 and bar 50 are suitably secured in fixed spaced relation, as by rigid connecting members 52. In one arrangement, the bar 50 is a length of angle iron, and the connecting members 52 are shaped with split ends so that one end is slipped onto the shaft 40 and the other end is slipped onto one side of the angle iron, and both ends are suitable clamped to the elements as by set screws and nut-and-bolt fasteners.

Figure 4:
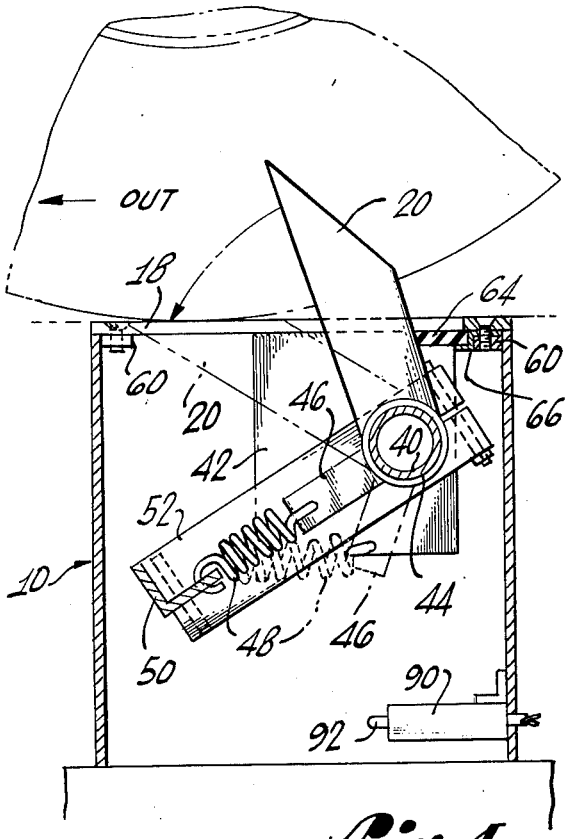
FIG. 4 is a sectional view taken along the line 4—4 of FIG. 1, illustrative the operative position of the teeth to permit traffic flow in one direction.

Still referring to FIGS. 4 and 6, the top plate 16 is secured to tabs 60 which are welded to the side walls of the frame or housing 10 adjacent the top opening of the housing. Adjacent the closed ends of the slots 18 is a strip 64 of rubber or other compressible material. One edge of the strip 64 is supported on a lip of an extrusion 66 that is located beneath the plate 16 and secured together therewith to the tabs 60 along that side of the housing 10. The strip 64 may also rest in relieved portions of the top edges of the shaft support elements 42. The strip 64 absorbs the force with which the teeth 20 snap back after being depressed by the wheel of a vehicle.

In this latter regard, the tooth 20 in FIG. 4 is shown normally biased in extended position. When a vehicle wheel moving in the allowed direction (to the left in FIG. 4) engages the tooth, it is forced downwardly via rotation of its hub 44 on the shaft 40. The spring 48 is stretched because the end thereof attached to the finger 46 is moved with the finger. Because of the tension in the spring, its action after the tooth 20 is cleared by the wheel is to snap the tooth back to its normal position.

Figure 2:
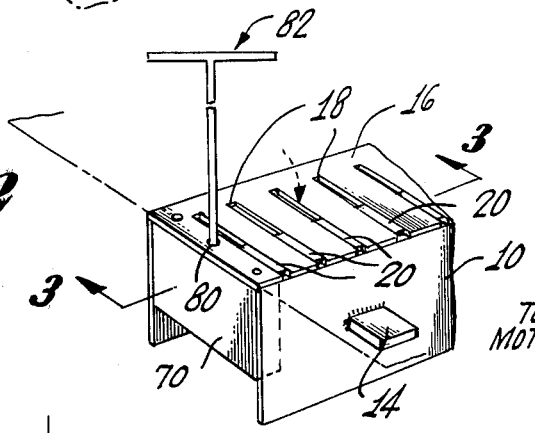
FIG. 2 is a fragmentary view in perspective of the traffic control apparatus wherein all teeth have been lowered to permit traffic flow in both directions.
Figure 5:
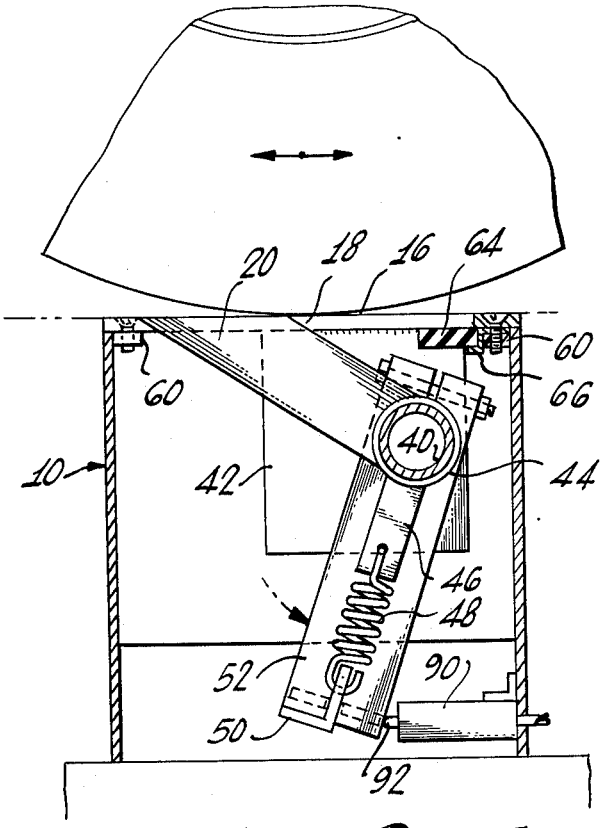
FIG. 5 is a sectional view like FIG. 4 but showing the teeth and associated assembly lowered to permit traffic flow in both directions.

Referring to FIGS. 1–3, 5 and 6, the housing 70 of a gear mechanism is secured to the surface 16, such mechanism being illustrated as gears 72, 74, one of which is keyed at 76 to the shaft 40, and the other of which is adapted to be engaged through an opening 80 in plate 16 by a crank 82 for selecting the angular position for the shaft 40. When the shaft is thus rotated via the gears, the bar 50 moves in unison therewith via the rigid connecting members 52. Accordingly, since the springs 48 are connected between the bar 50 and fingers 46, the teeth 20 are all moved simultaneously with the bar 50 between their extended positions (FIGS. 1 and 4) and their inoperative positions (FIGS. 2 and 5).

It should be noted that when the teeth are cranked to their extended positions, their movement is stopped when they engage the bumper strip 64. Continued operation of the gears effects further movement of the shaft 40 and bar 50 in the same direction, whereupon the springs 48 are stretched to a desired degree. The snap back action of the teeth that are depressed by a vehicle tire is thus selectively settable via this invention in addition to positioning of the teeth in extended position.

When the gears are operated to rotate the shaft 40 and bar 50 from the extended position of the teeth, the teeth are caused to move in unison with the shaft and bar to their inoperative positions wherein all teeth are located within the slots and are retained below the top surface of the plate 16. The parts are held in this position until the gears are operated to move the teeth to extended position.

The gear arrangement preferably has sufficient mechanical advantage to insure that the parts remain in the positions selected after the gear movement has stopped. The gear operated by the crank 82 rotates several revolutions in moving the other gear, and hence the shaft 40, through the relatively few degrees needed to move the teeth between their extreme positions.

Figure 7:
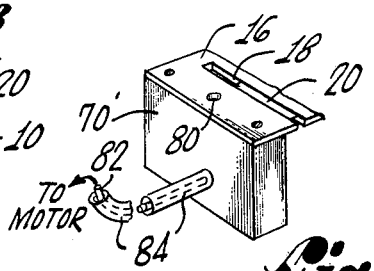
FIG. 7 is a fragmentary view in perspective of the traffic control apparatus, showing a different operating means for positioning the teeth in either the position for permitting traffic flow in one direction or for positioning them in the position to permit traffic flow in both directions.

This invention embraces other means for selectively operating the shaft 40 and positioning the teeth 20 in either of the extreme positions of the teeth. For example, and referring to FIG. 7, the gear mechanism may be arranged for operation by remote control and/or manually at the site. In FIG. 7, the gear box is indicated at 70′, and a sheath 84 extending from such housing contains a flexible shaft 86 connected to the gear mechanism and to the shaft of a remote motor (not shown). Alternately, a motor may be located within the housing for operating the gears, and the sheath 84 carries electrical wiring to a remote control switch (not shown) at a convenient location from which the desired positioning of the teeth may be effected.

As will now be apparent, traffic control apparatus in accordance with the invention can easily and quickly be removed for repair and replacement of parts, as well as being characterized by ease of assembly. Since all parts are supported from the surface plate 16, it is necessary only to loosen the fasteners which secure the plate 16 in the top of the housing 10, and the entire assembly is made accessible by simply turning the plate 16 over so it rests on its top surface (after operating the gears to move the teeth to inoperative position). After making the needed repairs and replacements, reassembly is achieved with like ease and loss of down time.

Correlatively, initial assembly of the parts is achieved with substantial savings in time, money and effort than has heretofore been realizable with traffic control apparatus heretofore known which do not have the advantages of the apparatus of this invention.

The invention is also adapted to perform specific desired functions by virtue of the selective positionability as described. For example, referring to FIGS. 4 and 5, a switching device 90 secured in the lower portion of the housing 10 has a plunger 92 to be depressed for changing the operation of an external circuit (not shown), e.g., for the gate control mechanism in the housing 26 of FIG. 1. The switch 90 is operated only in the inoperative position of the teeth 20, i.e., when the shaft 40 is rotated to cause the bar to rotate downwardly.

I claim:

1. In combination:

a hollow rectangular housing having a top opening;

a plate covering said top opening, said plate having a plurality of parallel slots extending from one longitudinal edge and terminating adjacent the opposite edge;

spaced brackets welded to the bottom surface of said plate, a shaft rotatably supported by said brackets;

gear means having a housing secured to the bottom surface of said plate, said gear means being operatively coupled to said shaft at one end thereof;

a bar of substantially the length of said shaft;

rigid connecting members securing said bar and said shaft in fixed spaced relation with said bar parallel to said shaft;

a plurality of sleeves slidably positioned on and rotatable on said shaft, a respective tooth integral with each sleeve, and a respective finger integral with each sleeve, and a respective tension spring connected at one end to each finger, the remaining ends of all said springs being connected to said bar.

2. The combination of claim 1, wherein said plate has an opening to receive crank means for operating said gear means.

3. The combination of claim 1, wherein said housing has spaced tabs integral with the longitudinal side walls thereof adjacent the top opening;

and means releasably fastening said plate to said tabs.

4. The combination of claim 1, wherein said rigid connecting members are releasable secured to both said shaft and said bar.

5. The combination of claim 3, including a strip of compressible material, and means supporting said strip so that a portion thereof spans each slot adjacent the closed end thereof, including an extruded support element having a ledge supporting said strip and being fastened to the tabs adjacent said one longitudinal edge of said plate.

6. The combination of claim 1, including means for operating said gear means from a location remote therefrom.

7. The combination of claim 1, including gate means having a gate to be raised and lowered, and gate operating means for raising and lowering said gate;

and means operable with said gear means to condition said gate operating means for placing said gate in one position when said shaft is rotated to a position wherein all said teeth extend through the slots in said plate, and for placing said gate in its other position when said shaft is rotated to a position wherein said bar causes all said teeth to be positioned below the top surface of said plate.

8. The combination of claim 1, including a shock absorbing strip spanning each slot adjacent its closed end, said shaft and bar being rotatable in unison via said gear means, said sleeves, teeth and fingers being movable with said springs during movement of said bar, said teeth having one extreme position wherein they engage said strip, said shaft and bar being further rotatable relative to said sleeves after operation of said gear means to cause said teeth to reach said one extreme position, said springs being stretched in accordance with the extent to which said shaft and bar are further rotated, and said teeth having another extreme position wherein they do not extend above the top surface of said plate.

* * * * *